US006419478B1

(12) United States Patent
Kemp

(10) Patent No.: US 6,419,478 B1
(45) Date of Patent: Jul. 16, 2002

(54) STEPPER MOTOR DRIVING A LINEAR ACTUATOR OPERATING A PRESSURE CONTROL REGULATOR

(75) Inventor: Stephen J. Kemp, Eagan, MN (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/447,999

(22) Filed: Nov. 23, 1999

(51) Int. Cl.[7] ..... F23N 5/00

(52) U.S. Cl. ..... 431/12; 18/89; 18/255; 251/129.08; 126/39 BA

(58) Field of Search ..... 431/75, 255, 12, 431/18, 89, 90, 355; 251/129.08, 328, 332, 329; 126/110 R, 110 E, 39 R, 39 BA

(56) References Cited

U.S. PATENT DOCUMENTS 3,759,244 A * 9/1973 Konet ..... 126/110 R
4,843,273 A * 6/1989 Dammers et al. ..... 126/110 B
5,234,196 A * 8/1993 Harris ..... 431/355
5,311,849 A * 5/1994 Lambert et al. ..... 123/337
5,546,908 A 8/1996 Stokes
5,931,655 A 8/1999 Maher, Jr.

* cited by examiner

*Primary Examiner*—James C. Yeung

(57) ABSTRACT

An apparatus for and method for controlling the gas supply of a gas appliance. The gas appliance has a main burner with a main valve controlled by a linear actuator. A stepper motor positions the linear actuator under control of a microprocessor. The stepper motor and microprocessor are powered from a thermopile having its output converted to the appropriate voltages by a DC-to-DC converter. Changes in valve position permit changes of fuel type and flame intensity.

20 Claims, 7 Drawing Sheets

STEPPER MOTOR DRIVING A LINEAR ACTUATOR OPERATING A PRESSURE CONTROL REGULATOR

BACKGROUND OF THE INVENTION

1. Field of the Invention

The present invention generally relates to systems for control of an appliance incorporating a flame and more particularly relates to flame control valve systems.

2. Description of the prior art

It is known in the art to employ various appliances for household and industrial applications which utilize a fuel such as natural gas (i.e., methane), propane, or similar gaseous hydrocarbons. Typically, such appliances have the primary heat supplied by a main burner with a substantial pressurized gas input regulated via a main valve. Ordinarily, the main burner consumes so much fuel and generates so much heat that the main burner is ignited only as necessary. At other times (e.g., the appliance is not used, etc.), the main valve is closed extinguishing the main burner flame.

A customary approach to reigniting the main burner whenever needed is through the use of a pilot light. The pilot light is a second, much smaller burner, having a small pressurized gas input regulated via a pilot valve. In most installations, the pilot light is intended to burn perpetually. Thus, turning the main valve on provides fuel to the main burner which is quickly ignited by the pilot light flame. Turning the main valve off, extinguishes the main burner, which can readily be reignited by the presence of the pilot light.

These fuels, being toxic and highly flammable, are particularly dangerous in a gaseous state if released into the ambient. Therefore, it is customary to provide certain safety features for ensuring that the pilot valve and main valve are never open when a flame is not present preventing release of the fuel into the atmosphere. A standard approach uses a thermogenerative electrical device (e.g., thermocouple, thermopile, etc.) in close proximity to the properly operating flame. Whenever the corresponding flame is present, the thermocouple generates a current. A solenoid operated portion of the pilot valve and the main valve require the presence of a current from the thermocouple to maintain the corresponding valve in the open position. Therefore, if no flame is present and the thermocouple(s) is cold and not generating current, neither the pilot valve nor the main valve will release any fuel.

In practice, the pilot light is ignited infrequently such as at installation, loss of fuel supply, etc. Ignition is accomplished by manually overriding the safety feature and holding the pilot valve open while the pilot light is lit using a match or piezo igniter. The manual override is held until the heat from the pilot flame is sufficient to cause the thermocouple to generate enough current to hold the safety solenoid. The pilot valve remains open as long as the thermocouple continues to generate sufficient current to actuate the pilot valve solenoid.

The safety thermocouple(s) can be replaced with a thermopile(s) for generation of additional electrical current. This additional current may be desired for operating various indicators or for powering interfaces to equipment external to the appliance. Normally, this requires conversion of the electrical energy produced by the thermopile to a voltage useful to these additional loads. Though not suitable for this application, U.S. Pat. No. 5,822,200, issued to Stasz; U.S. Pat. No. 5,804,950, issued to Hwang et al.; U.S. Pat. No. 5,381,298, issued to Shaw et al.; U.S. Pat. No. 4,014,165, issued to Barton; and U.S. Pat. No. 3,992,585, issued to Turner et al. all discuss some form of voltage conversion.

Upon loss of flame (e.g., from loss of fuel pressure), the thermocouple(s) ceases generating electrical current and the pilot valve and main valve are closed, of course, in keeping with normal safety requirements. Yet this function involves only a binary result (i.e., valve completely on or valve completely off). Though it is common within vehicles, such as automobiles, to provide variable fuel valve control as discussed in U.S. Pat. No. 5,546,908, issued to Stokes, and U.S. Pat. No. 5,311,849, issued to Lambert et al., it is normal to provide static gas appliances with a simple on or off, linearly actuated valve having the desired safety features.

Yet, there are occasions when it is desirable to adjust the outlet pressure regulation point of the main burner supply valve of a standard gas appliance. These include changes in mode (i.e., changes in the desired intensity of the flame) and changes in the fuel type (e.g., a change from propane to methane). U.S. Pat. No. 5,234,196, issued to Harris, suggests an approach to variable valve positioning of a gas appliance. However, the introduction of an entirely new valve design is likely to introduce severe regulatory difficulties. The present safety valve approach has been used for such a long time with satisfactory results. Proof of safe operation of a new approach to valve design would require substantial costly end user testing.

SUMMARY OF THE INVENTION

The present invention overcomes the disadvantages of the prior art by providing a main burner valve for a gas appliance which utilizes a standard, linearly actuated valve design having proven safety features, but which also offers precisely controllable differing outlet pressure regulation point. Linear actuation is important, because it offers the normal safety features associated with the industry standard of full off upon flame out. However, because the valve of the present invention may be positioned along the entire length of its travel from full open to full closed, the valve is totally adjustable permitting changes in mode, fuel input, and other outlet pressure related features.

In accordance with the preferred mode of the present invention, a thermopile is thermally coupled to the pilot flame. As current is generated by the thermopile, it is converted via a DC-to-DC converter to a regulated output and an unregulated output. The regulated output powers a microprocessor and other electronic circuitry which control operation of the main fuel valve in response to sensed conditions, operator inputs, and certain stored data. The unregulated output powers various mechanical components including a stepper motor.

The stepper motor is mechanically coupled to a linear actuator which precisely positions the main fuel valve. Because the main fuel valve is linearly actuated, it operates in known fashion with respect to the industry proven flame out safety features. Yet, the stepper motor, under direct control of the microprocessor, positions the linear actuator for precise valve positioning and therefore, fuel input modulation.

The use of a stepper motor means that any selected valve position is held statically by the internal rachet action of the stepper motor without quiescent consumption of any electrical energy. That makes the electrical duty cycle of the stepper motor/valve positioning system extremely low. This is a very important feature which permits the system to operate under the power of the thermopile without any necessary external electrical power source. In fact, the stepper motor duty cycle is sufficiently low, that the power supply can charge a capacitor slowly over time such that when needed, that capacitor can power the stepper motor to change the position of the linear actuator and hence the outlet pressure of the main fuel valve.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
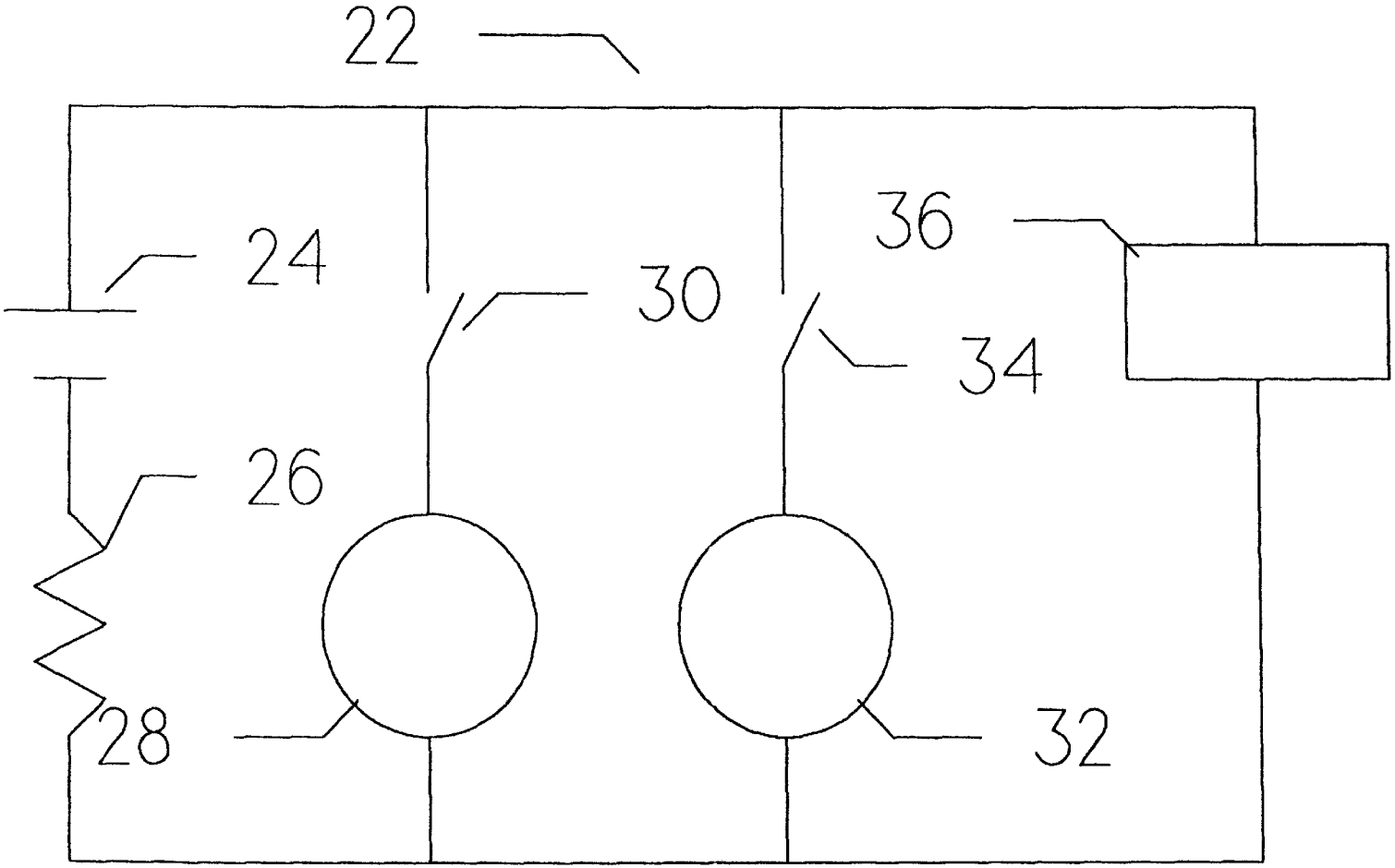
FIG. 1 is a simplified electrical schematic diagram of the present invention.

FIG. 1 is a very basic electrical diagram 22 of the power circuitry of the present invention. Thermopile 24 is structured in accordance with the prior art. Resistor 26 represents the internal resistance of thermopile 24.

Pilot valve 28 has a solenoid (not shown) which holds pilot valve 28 closed whenever sufficient current flows through the circuit. Similarly, another solenoid (also no separately shown) holds main valve 34 closed whenever sufficient current flows through the associated circuit.

DC-to-DC conversion facility 36 converts the relatively low voltage output of thermopile 24 to a sufficiently large voltage to power the second DC-to-DC converter. In accordance with the preferred mode of the present invention, DC-to-DC conversion facility 36 consists of two DC-to-DC converters. The first converter operates at the extremely low thermopile output voltages experienced during combustion chamber warm up. The other DC-to-DC converter powers the system during normal operation. A more detailed description of the second device is available in the above identified and incorporated, commonly assigned, co-pending U.S. Patent Applications.

Figure 2:
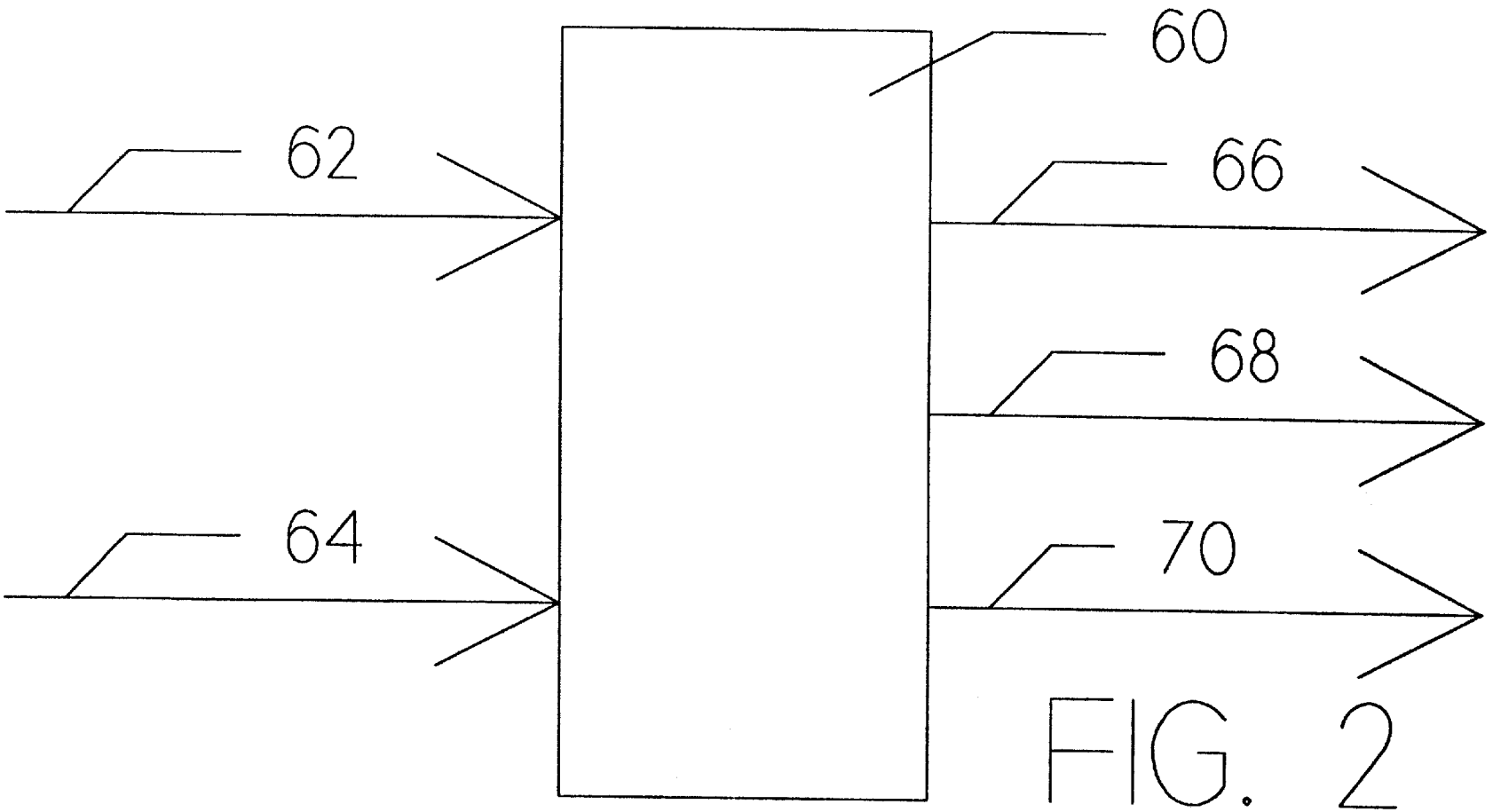
FIG. 2 is a simplified block diagram of the microprocessor of the present invention.

FIG. 2 is a simplified diagram showing the basic inputs and outputs of microprocessor 60. In the preferred mode, microprocessor 60 is an 8-bit AVR model AT90LS8535 microprocessor available from ATMEL. It is a high performance, low power, restricted instruction set (i.e., RISC) microprocessor. In the preferred mode, microprocessor 60 is clocked at one megahertz to save poser, even though the selected device may be clocked at up to four megahertz.

The two primary inputs to microprocessor 60 are the thermopile output voltage received via input 62 and the manual mode change information received via input 64. The thermopile output voltage is input once per second. The mode change information, on the other hand, is received aperiodically in response to manual action by the user.

Output 66 controls operation of the stepper motor. As is explained in more detail below, this affects management of the main fuel valve outlet pressure. Output 68 is the on/off control for the external circulation fan. Output 70 controls the radio frequency receiver through which an operator can communicate via a remote control device.

Figure 3:
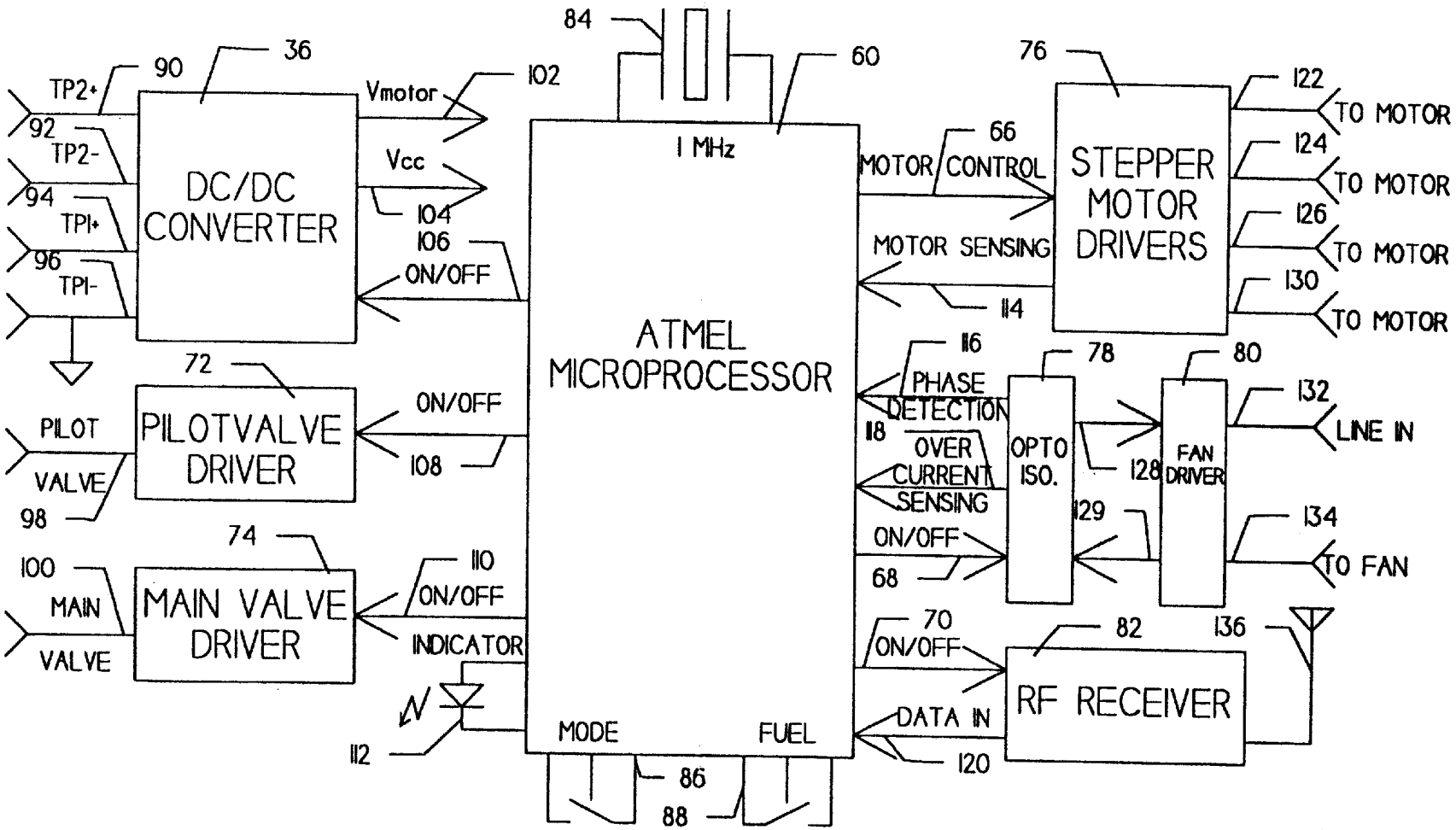
FIG. 3 is a detailed electrical block diagram.

FIG. 3 is a detailed block diagram of the inputs and outputs of microprocessor 60. One megahertz crystal 84 clocks microprocessor 60. The output of crystal 84 is also divided down to provide an interrupt to microprocessor 60 once per second. This interval is utilized for sampling of the thermopile output voltage. Manual mode switch 86 permits an operator to select local mode or remote mode. Similarly, manual switch 88 is used to select the input fuel type, so that the main valve outlet pressure can be switched between propane and methane. Indicator 112 permits early notification of flame on to the user.

DC-to-DC converter 36 can receiver inputs from up to two thermopiles. Inputs 94 and 96 provide the positive and negative inputs from the first thermopile, whereas inputs 90 and 92 provide the positive and negative inputs from the second thermopile, respectively. Output 102 is the unregulated output of DC-to-DC converter 36. This output has a voltage varying between about 6 volts and 10 volts. The unregulated output powers the mechanical components, including the stepper motor. Line 104 is a 3 volt regulated output. It powers microprocessor 60 and the most critical electronic components. Line 106 permits microprocessor to power DC-to-DC converter 36 up and down. This is consistent with the voltage sampling and analysis by microprocessor 60 which predicts flame out conditions.

Line 72 enables and disables pilot valve driver 72 coupled to the pilot valve via line 98. Similarly, line 110 controls main valve driver 74 coupled to the main valve via line 100. This is important because microprocessor 60 can predict flame out conditions and shut down the pilot and main valves long before the output of the thermopile is insufficient to hold the valves open. A more detailed description of this significant feature may be found in the above referenced, co-pending, commonly assigned, and incorporated U.S. Patent Applications.

Stepper motor drivers 76 are semiconductor switches which permit the output of discrete signals from microprocessor 60 to control the relatively heavy current required to drive the stepper motor. In that way, line 66 controls the stepper motor positioning in accordance with the direction of the microprocessor firmware. Line 114 permits sensing of the stepper motor status. Lines 122, 124, 126, and 130 provide the actual stepper motor current.

In the preferred mode of practicing the present invention, the gas appliance is a fireplace. The thermopile output is not sufficient to power the desired fan. However, the system can control operation of the fan. Therefore, line 132 provides the external power which is controlled by fan driver 80. Lines 128 and 129 couple to optical isolation device 78 for coupling via lines 68, 116, and 118 to microprocessor 60. Line 134 actually powers the fan.

The fireplace of the preferred mode also has radio frequency remote control. A battery operated transmitter communicates with rf receiver 82 via antenna 136. Lines 70 and 120 provide the interface to microprocessor 60. Rf receiver 82 is powered by the 3 volt regulated output of DC-to-DC converter 36 found on line 104.

Figure 4:
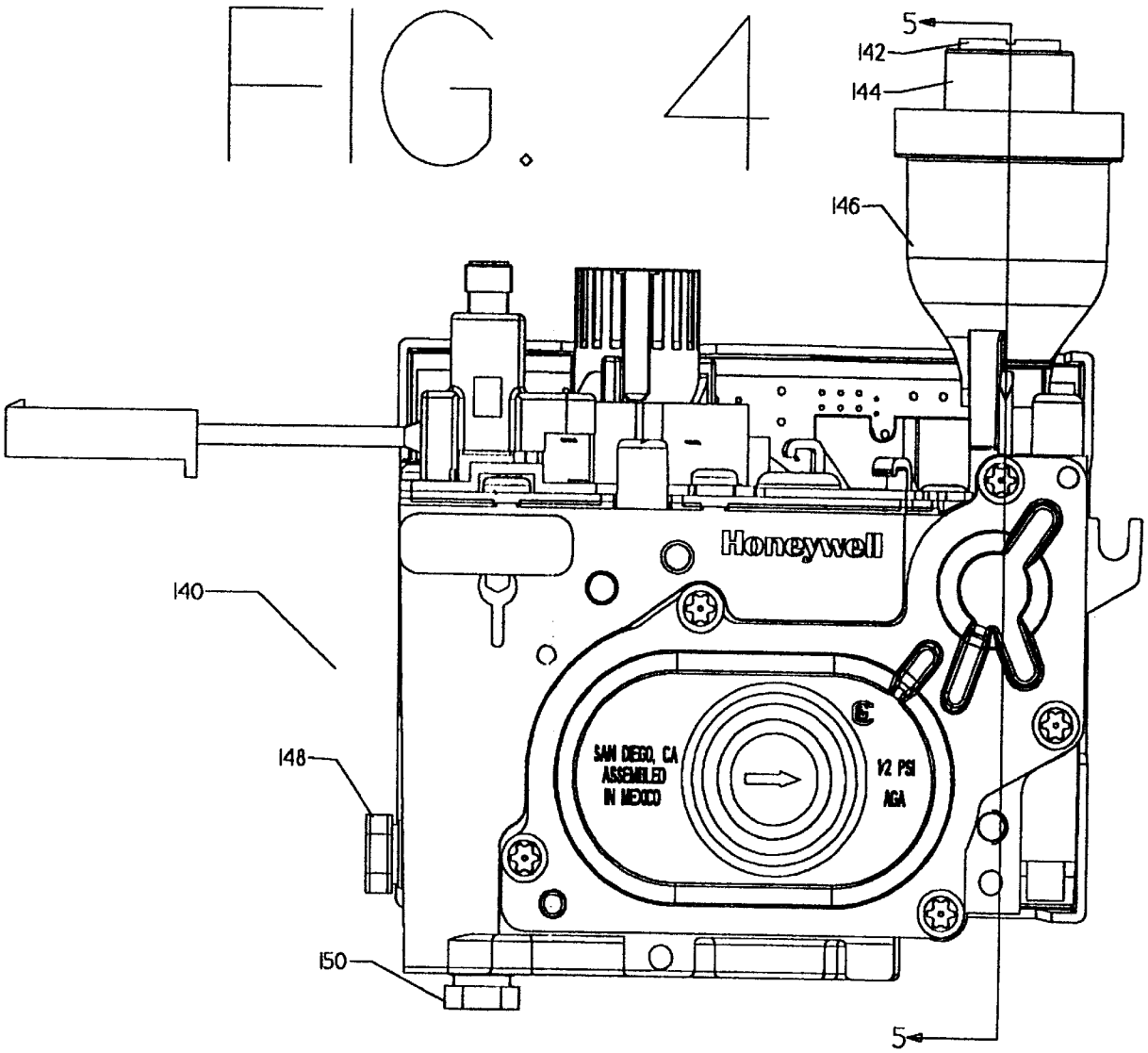
FIG. 4 is a plan view of the valve assembly.

FIG. 4 is a plan view of the valve assembly 140 of the preferred mode of the present invention. Fuel inlet 150 has standard fittings. Similarly, gas outlet 148 includes a standard coupling. Regulator cap 142 fits within housing cap 144 as shown (a better view is found in the section of FIG. 5). Motor housing 146 contains the linear actuator and stepper motor (neither shown in this view).

Figure 5:
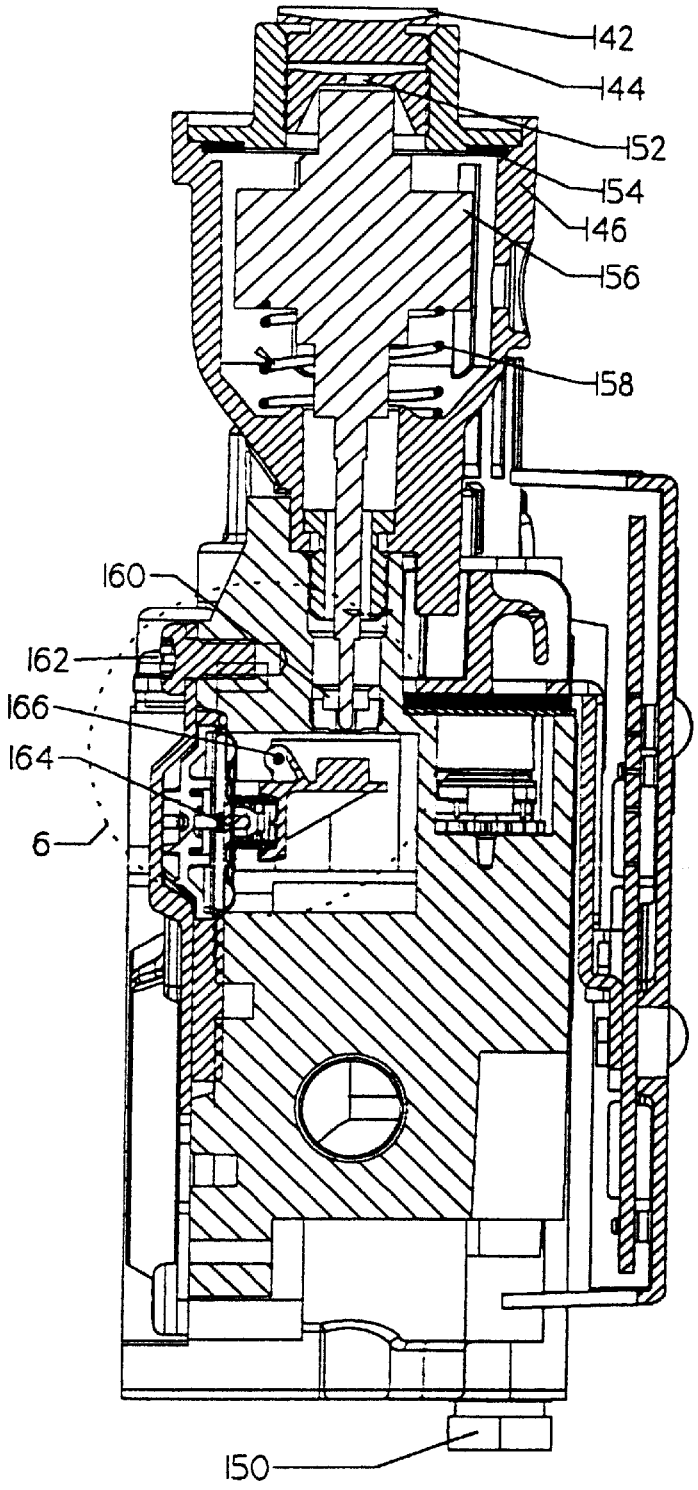
FIG. 5 is a sectioned view of the valve assembly.

FIG. 5 is a sectioned view of valve assembly 140 taken along the section line shown in FIG. 4. High adjustment screw 152 sets the upper limit of travel of linear actuator 156 The lower limit is set by low adjustment nut 162. Housing gasket 154 seals housing cap 144 against motor housing 146. Linear actuator 156 is biased toward regulator cap 142 by motor spring 158. Housing screw 160 translates the rotational motion of the stepper motor to the linear motion required to operated linear actuator 156.

The valve action which causes a change in effective fuel outlet pressure operates on pivot 166. The valve moves in response to the position of linear actuator 156. Flame stability is provided by servo pressure regulator 164. Reference line 6 defines the closeup shown in FIG. 6.

Figure 6:
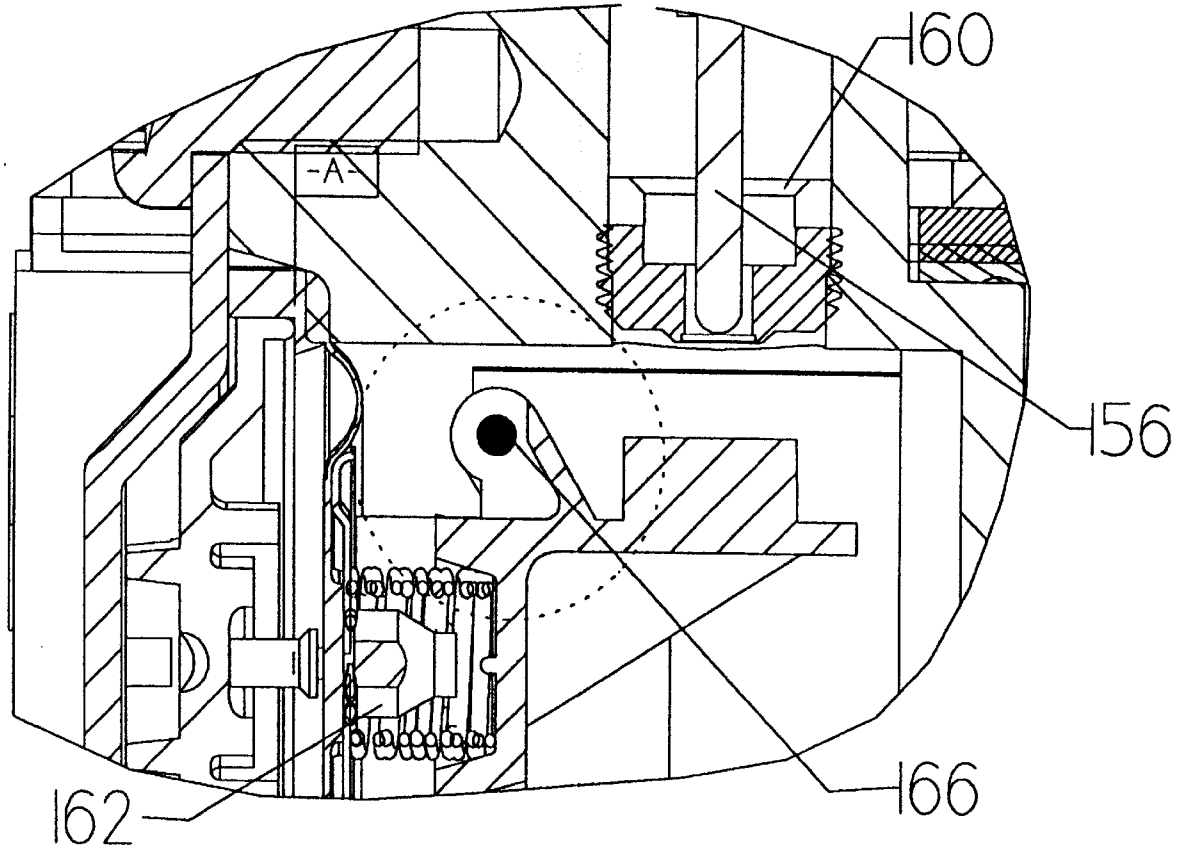
FIG. 6 is a closeup of a portion of the section of FIG. 5.

FIG. 6 is a closeup of the identified portion of FIG. 5. The key components are as previously described. Reference line 7 defines the closeup shown in FIG. 7.

Figure 7:
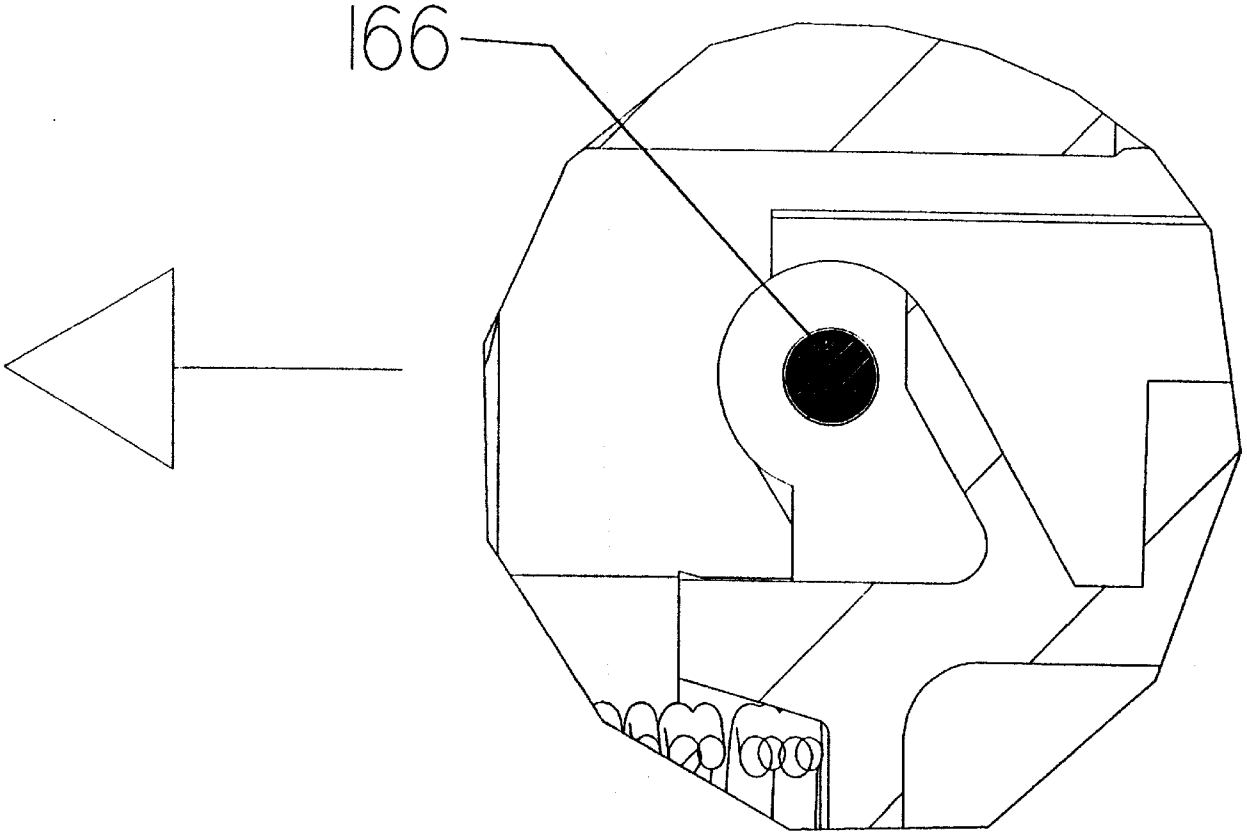
FIG. 7 is a further closeup of the section of FIG. 6.

FIG. 7 is provides the closeup identified in FIG. 6. All key components are as previously described.

Having thus described the preferred embodiments of the present invention, those of skill in the art will be readily able to adapt the teachings found herein to yet other embodiments within the scope of the claims hereto attached.

I claim:

1. In a gas appliance having a flame produced by a main burner wherein said flame of said main burner is controlled by a main valve having a linear actuator, the improvement comprising:

a. A second flame;

b. A conversion device thermally coupled to said second flame which generates an electrical current; and c. An electrically powered device powered by said electrical current from said conversion device for positioning said linear actuator which modulates the intensity of said flame.

2. The improvement according to claim 1 further comprising an electronic circuit powered by said electrical current from said conversion device for controlling the position of said linear actuator.

3. The improvement according to claim 2 wherein said electronic circuit further comprises a microprocessor.

4. The improvement according to claim 3 wherein said electrically powered device further comprises a stepper motor.

5. The improvement according to claim 4 wherein said second flame further comprises a pilot flame.

6. An apparatus comprising:

a. A gas inlet;

b. A gas outlet;

c. A regulator valve interposed between said gas inlet and said gas outlet;

d. A burner responsively coupled to said gas outlet, for producing a flame;

e. An electrical conversion device responsively coupled to said flame which converts energy received from said flame into electrical energy;

f. A linear actuator responsively coupled to said regulator valve; and g. An electrical device responsively coupled to said linear actuator which controllably positions said linear actuator to modulate flow of said gas from said gas inlet to said gas outlet.

7. An apparatus according to claim 6 wherein said electrical device further comprises a stepper motor.

8. An apparatus according to claim 7 further comprising a microprocessor responsively coupled to said stepper motor which controls actuation of said stepper motor.

9. An apparatus according to claim 6 wherein the burner is a pilot burner.

10. An apparatus according to claim 9 wherein said electrical energy powers said electrical device and said microprocessor.

11. A method of controlling the main flame of a gas appliance having a pilot flame comprising:

a. Generating an electrical output from energy received from said pilot flame;

b. Adjusting the size of a main valve orifice in response to the position of a linear actuator; and c. controlling said position of said linear actuator using an electrical device powered by said electrical output.

12. A method according to claim 11 further comprising:

a. Controlling said electrical device using a microprocessor.

13. A method according to claim 12 wherein said electrical device further comprises a stepper motor.

14. A method according to claim 13 wherein said gas appliance has a converter for increasing the voltage of said electrical output.

15. A method according to claim 14 wherein said electrical device and said microprocessor are powered by said electrical output.

16. An apparatus comprising:

a. Means for producing a pilot flame;

b. Means thermally coupled to said producing means for generating an electrical output;

c. Means for supplying gas;

d. Means responsively coupled to said supplying means for controlling flow of said gas by positioning a linear actuator; and e. Means powered by said generating means and responsively coupled to said controlling means for electrically moving said linear actuator thereby modulating flow of said gas.

17. An apparatus according to claim 16 further comprising means responsively coupled to said moving means for directing said moving means to move said linear actuator.

18. An apparatus according to claim 17 wherein said moving means further comprises a stepper motor.

19. An apparatus according to claim 18 wherein said directing means further comprises a microprocessor.

20. An apparatus according to claim 19 wherein said generating means further comprises means for increasing the voltage of said electrical output.

* * * * *